US012629579B1

(12) United States Patent
Cheron et al.

(10) Patent No.: US 12,629,579 B1
(45) Date of Patent: May 19, 2026

(54) LUGGAGE PIECE FOR CREASE-FREE FENCING EQUIPMENT

(71) Applicants: Helene Jiaqi Amy Cheron, McKinney, TX (US); Xuan Song, McKinney, TX (US)

(72) Inventors: Helene Jiaqi Amy Cheron, McKinney, TX (US); Xuan Song, McKinney, TX (US)

( * ) Notice: Subject to any disclaimer, the term of this patent is extended or adjusted under 35 U.S.C. 154(b) by 0 days.

(21) Appl. No.: 19/385,309

(22) Filed: Nov. 11, 2025

(51) Int. Cl.
*A63B 71/00* (2006.01)

(52) U.S. Cl.
CPC ..... *A63B 71/0036* (2013.01)

(58) Field of Classification Search
CPC ..... A63B 71/0036; A63B 69/02; A63B 2069/025
USPC ..... 206/315.1; 190/109, 111
See application file for complete search history.

(56) References Cited

U.S. PATENT DOCUMENTS 5,228,547 A * 7/1993 Yoo ..... A45C 3/00 190/111
8,544,642 B1 * 10/2013 Lytle ..... A45F 3/02 150/159
2002/0024272 A1 * 2/2002 Eschenfelder ..... A47B 87/02 312/100
2003/0062233 A1 * 4/2003 Sharples ..... A45C 5/06 190/111
2006/0228201 A1 * 10/2006 Lenceski ..... A63B 71/0045 414/466
2010/0051505 A1 * 3/2010 Thomas ..... A63B 53/00 206/774
2010/0200350 A1 * 8/2010 Henry ..... A45C 3/12 190/109
2010/0300906 A1 * 12/2010 Moore ..... A45C 13/02 206/315.1
2012/0145718 A1 * 6/2012 Quarry ..... A45C 11/20 220/507
2012/0234706 A1 * 9/2012 Underfer ..... A63C 11/025 206/278
2017/0368440 A1 * 12/2017 Graham ..... B62B 3/10
2020/0283041 A1 * 9/2020 Centeno ..... A63B 71/0045
2022/0241665 A1 * 8/2022 Dalebout ..... A63B 71/0036
2024/0306781 A1 * 9/2024 Colucci ..... A63B 71/0036

* cited by examiner

*Primary Examiner* — Jacob K Ackun

(57) ABSTRACT

A luggage piece may be sized to and include features that facilitate storage and transportation of fencing equipment such that the luggage piece decreases a likelihood of damaging the fencing equipment during storage and transportation. The luggage piece may include a first shell formed by a back panel, first cover, first lid, and foundation in which one or more pieces of fencing equipment may be stored in an interior space of the first shell in one or more compartments. The first cover may include a curved profile shape that bows out relative to the interior space of the first shell to facilitate storage of lames without creasing electrical wiring of the lames. The luggage piece may include a second shell formed by the back panel, a second cover, a second lid in which one or more fencing swords may be stored.

18 Claims, 7 Drawing Sheets

LUGGAGE PIECE FOR CREASE-FREE FENCING EQUIPMENT

FIELD OF THE INVENTION

The present disclosure generally relates to luggage pieces for transporting fencing equipment.

BACKGROUND

Fencing is a recreational and competitive sport that involves two parties or "fencers" participating in sword fighting. A fencer who performs an attack with a fencing sword that successfully contacts another fencer may be awarded a point in accordance with fencing rules. The fencer who first accumulates a predetermined number of points, typically five or fifteen points, is considered the winner of a fencing match.

Fencing swords used in recreational and competitive fencing matches may be made of metal, such as iron, steel, any metal alloys, or some combination thereof, and shaped into thin strips. Consequently, fencers are often required to wear particular articles of clothing and protective equipment (referred to herein as "fencing equipment") during fencing matches to protect the fencers from physical injuries during the course of the fencing match. Fencing equipment is often made of thick fabrics to soften the force of attacks made with fencing swords.

Because scoring points in a fencing match is determined in part by making contact between the fencing sword and an opposing fencer's body within the rules of fencing, sections of the fencing equipment may be overlaid with an electrically conductive mesh layer. The mesh layer may be connected to an open electrical circuit that is closed upon contact between the fencing sword and any part of the mesh layer associated with the fencing equipment worn by the opposing fencer. Closing the electrical circuit may result in triggering a visual signal, such as a colored light, an audio signal, such as an alarm sound, or some combination thereof to indicate that a point has been scored by either of the fencers. Such processes of determining whether a point has been scored may be less subjective and more accurate than relying on visual determination by a judge or a referee observing the fencing match due to the fast-paced nature of actions performed by the fencers.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

A luggage piece may include dimensions, shapes, features, some combination thereof, or any other details that facilitate storage of fencing equipment in the luggage piece while decreasing a likelihood of damaging the fencing equipment during storage and transportation of the fencing equipment in the luggage piece. According to an aspect of an embodiment, the luggage piece may include a first shell formed by a back panel, a first cover, a first lid, and a foundation. The back panel, the first cover, the first lid section, and the foundation may define an interior space of the first shell that includes a curved profile shape that bows out relative to the interior space of the first shell. A first compartment within the interior space of the first shell may be defined by the back panel, a first surface of a partition positioned inside of the interior space of the first shell, a compartment separator, the first cover, and the first lid. A second compartment within the interior space of the first shell may be defined by the back panel, a second surface of the partition, the compartment separator, the first cover, and the first lid. A third compartment within the interior space of the first shell may be defined by the back panel, the first surface of the partition, the compartment separator, the first cover, and the foundation. A fourth compartment within the interior space of the first shell may be defined by the back panel, the second surface of the partition, the compartment separator, the first cover, and the foundation. A second shell may be formed by the back panel, a second cover, a second lid, and the first lid. The back panel, the second cover, the second lid, and the first lid may define an interior space of the second shell, and the interior space of the second shell may demarcate a fifth compartment.

The object and advantages of the embodiments will be realized and achieved at least by the elements, features, and combinations particularly pointed out in the claims. It is to be understood that both the foregoing general description and the following detailed description are explanatory and are not restrictive of the invention, as claimed.

BRIEF DESCRIPTION OF THE DRAWINGS

Example embodiments will be described and explained with additional specificity and detail through the accompanying drawings in which.

DETAILED DESCRIPTION

Figure 1:
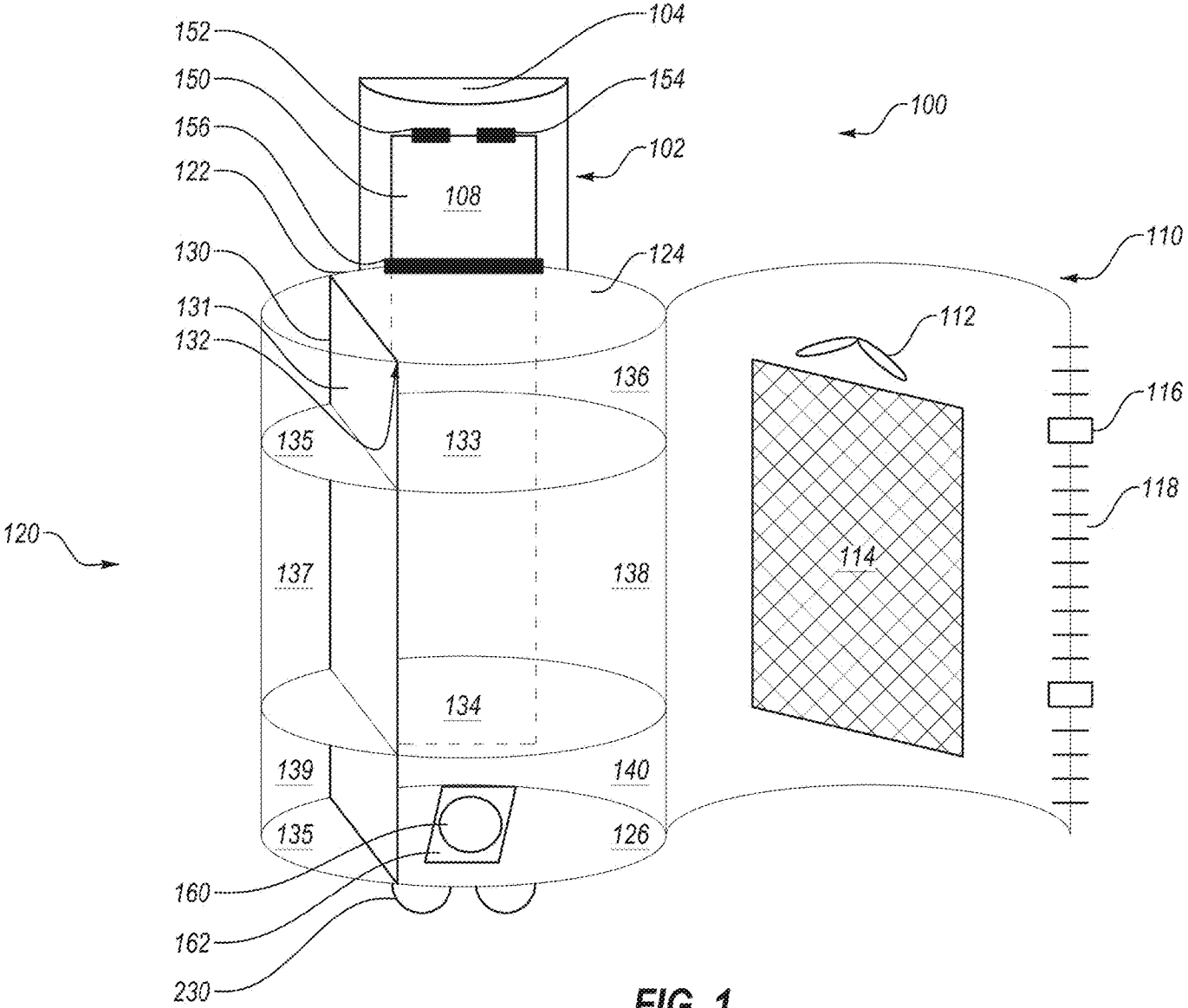
FIG. 1 illustrates an interior view of the luggage piece according to one or more embodiments of the present disclosure.

Modern fencing frequently involves a wide array of fencing equipment to facilitate electrical scorekeeping. Weapons are categorized as foils, epees, or sabers (collectively referred to herein as "fencing swords") depending on the manner in which the fencing swords are used to score points in accordance with competition rules. The fencing swords may include conductive sockets into which wiring, referred to herein as "cords", are inserted to establish an electrical connection between the fencing swords and a scorekeeping machine. Furthermore, additional cords may be used to connect the scorekeeping machine to other equipment being used by fencers, such as branching cords that connect to a jacket worn by a fencer called a lame. Additionally or alternatively, a separate cord may be used to connect the lame to a protective mask worn by the fencer so that the mask is also electrically connected to the scorekeeping machine. To facilitate electrical connection between the scorekeeping machine and various pieces of equipment worn by the fencer, at least some parts of the lame and mask may be inlaid with electrically conductive materials typically in the form of a flexible metal mesh.

Usage of electrically conductive fencing equipment, such as the cords, the lame, and the mask, over time may result in portions of the electrically conductive material wearing down and malfunctioning. Constant contact and other physical stresses being applied to the fencing equipment may result in the fencing equipment breaking and needing to be replaced. For example, fabric used in the fencing equipment may be torn. As an additional or alternative example, wiring included in the metal mesh of the lame, the metal mesh of the mask, one or more of the cords, or some combination thereof may be damaged. The frequency of fencing equipment replacement may be further exacerbated because portions of the electrical mesh included in lames and masks may malfunction without the entirety of the lames and masks failing, resulting in electrically nonconductive areas that do not register as being hit when contacted by an opponent's fencing sword.

Such equipment issues are particularly problematic in the context of fencing competitions because fencing equipment is often inspected for electrical functionality and safety on-site at any given fencing competition. However, fencers may not realize cords or portions of other fencing equipment are broken until such inspections in part due to fencing equipment being damaged during transportation to the fencing competitions. Existing luggage pieces used to transport fencing equipment often use an elongated shape and a hard shell to make space for fencing swords to be stored with lower risk of being bent or snapped during transportation. Such existing luggage pieces may additionally or alternatively include one or more pouches, pockets, or other partitioned spaces to facilitate organization of fencing equipment. However, existing luggage pieces do not provide sufficient space to store lames, often the most expensive piece of fencing equipment, without needing to fold the lames over themselves on the conductive mesh fabrics of the lames. Consequently, lames are susceptible to electrical failure as portions of the electrical mesh fabric disconnects or are otherwise damaged during travel.

A luggage piece according to one or more embodiments of the present disclosure may provide a storage space that allows lames and other fencing equipment to be transported while decreasing the need to fold the lames and other fencing equipment to fit the fencing equipment inside of the luggage piece. For example, the luggage piece according to the present disclosure may include one or more embodiments that include a cover section that includes a substantially curved shape with sufficient surface area to fit a lame flush against the cover section. In some embodiments, the cover section may include a hanger, a mesh lining, some combination thereof, or any other components that facilitate keeping a lame fixed in place regardless of travel conditions. Using the luggage piece according to one or more embodiments of the present disclosure may decrease the chance of damaging one or more pieces of fencing equipment during transportation of the fencing equipment, such as via air travel as checked baggage or carry-on baggage.

Embodiments of the present disclosure will be explained with reference to the accompanying drawings. It should be understood that the following descriptions of the embodiments of the present disclosure are not intended to limit examples, implementations, and/or embodiments to those described expressly in the present disclosure. Modifications, additions, or omissions may be made within the scope of the present disclosure as defined by the claims. Further, the present disclosure may include any number of other elements or may be implemented within other systems or contexts than those described.

FIG. 1 illustrates an interior view of a luggage piece 100 according to one or more embodiments of the present disclosure. The luggage piece 100 may include a first shell 120 that includes an interior space formed by a first lid 122, a first cover 110, a back panel 124, and a foundation 126. One or more partitions and/or one or more compartment separators may be positioned inside of the interior space of the first shell 120 to form compartments inside of the first shell 120. As illustrated in FIG. 1, for example, a partition 130 may be positioned inside of the first shell 120 and span a length of the first shell 120 in addition to a first compartment separator 133 and a second compartment separator 134.

In some embodiments, the first lid 122 and/or the foundation 126 may be connected to the back panel 124 at approximately ninety degree angles to form multiple sides of the first shell 120 of the luggage piece 100. The first cover 110 may be attached to the first lid 122, the back panel 124, the foundation 126, or some combination thereof, resulting in the first shell 120 having a semi-cylindrical or substantially semi-cylindrical shape with the back panel 124 having a substantially rectangular shape, and the first lid 122 and/or the foundation 126 having semi-circular shapes. In these and other embodiments, the first lid 122, the back panel 124, and/or the foundation 126 may be separate and substantially flat surfaces that are coupled together along one or more edges using a wire and/or plastic frame into which the first lid 122, the back panel 124, and/or the foundation 126 may be fitted. Additionally or alternatively, the first lid 122, the back panel 124, and/or the foundation 126 may be connected together as interlocking panels and/or injected molded to form a substantially semi-cylindrical shape.

The first lid 122 may be included to form a top surface of the first shell 120 and close the top of the first shell 120 from the exterior environment. In some embodiments, the first lid 122 may include a shape that corresponds with a cross-sectional shape of the first shell 120. For example, a cylindrical first shell 120 may include a first lid 122 with an ovular shape. In these and other embodiments, the first lid 122 may be attached to the first shell 120 along a hinge, a seam, or any other connecting interface that facilitates opening and/or closing the first lid 122, such as by a zipper, a clasp, or any other fastening mechanism.

The first cover 110 may or may not be attached to the first lid 122, the back panel 124, and the foundation 126 along all edges of the first cover 110 such that the first cover 110 may be moved and/or rotated to open the first shell 120 and expose the interior space of the first shell 120. Accordingly, the first cover 110 may be configured to open and/or close to provide access to and/or enclose the interior space of the first shell 120. Additionally or alternatively, one or more edges of the first cover 110 may be connected to edges and/or surfaces of the first lid 122, the back panel 124, and/or the foundation 126 to form one or more hinged openings and/or closing mechanisms that may secure the first cover 110 in place using one or more fasteners, such as clasps 116 and/or a zipper 118.

The first cover 110 may include a curved shape such that the lateral surface of the first shell 120 has a convex or similarly protruding profile. In some embodiments, a hanger 112 formed by one or more pegs, hooks, nobs, or any other protrusions may be fixed to an interior surface of the first cover 110 from which electrical cords, articles of clothing, or any other objects may be hanged. In these and other embodiments, the hanger 112 may include a curved shape corresponding to the curved shape of the first cover 110 to facilitate hanging fencing equipment, such as jackets and/or lames, against the interior surface of the first cover 110 without folding any part of the fencing equipment. By placing the luggage piece 100 in an upright position in which the foundation 126 is parallel to and substantially flush against the ground, fencing equipment may be hung against the interior surface of the first cover 110, and the first cover 110 may be closed to secure the stored fencing equipment.

Additionally or alternatively, a mesh net 114 may be attached to the interior surface of the first cover 110 to further secure fencing equipment against the first cover 110. For example, the mesh net 114 may include a rectangular shape and be attached to the first cover 110 along two or three sides of the mesh net 114 (e.g., the lateral sides and/or the bottom of the mesh net 114) so that fencing equipment may be secured between the first cover 110 and the mesh net 114. In some embodiments, the mesh net 114 may be elastic to allow for storing larger and/or overhanging pieces of fencing equipment by stretching the mesh net 114 to enlarge a space between the mesh net 114 and the interior surface of the first cover 110, placing the fencing equipment in the enlarged space, and releasing the mesh net 114 to securely interpose the fencing equipment between the mesh net 114 and the first cover 110.

In these and other embodiments, the first compartment separator 133 and the second compartment separator 134 may each be positioned parallel with respect to one another and perpendicular to the partition 130 such that compartments are formed in the interior space of the first shell 120. For example, a first side 131 of the partition 130, the first compartment separator 133, the back panel 124, the first lid 122, and the first cover 110 may form a first compartment 135. The second side 132 of the partition 130, the first compartment separator 133, the back panel 124, the first lid 122, and the first cover 110 may form a second compartment 136 that is adjacent to the first compartment 135 and separated by the partition 130.

In an additional or alternative example, the first side 131 of the partition 130, the first compartment separator 133, the back panel 124, the first cover 110, and the second compartment separator 134 may form a third compartment 137. The second side 132 of the partition 130, the first compartment separator 133, the back panel 124, the first cover 110, and the second compartment separator 134 may form a fourth compartment 138 that is adjacent to the third compartment 137 and separated by the partition 130.

In an additional or alternative example, the first side 131 of the partition 130, the second compartment separator 134, the back panel 124, the first cover 110, and the foundation 126 may form a fifth compartment 139. The second side 132 of the partition 130, the second compartment separator 134, the back panel 124, the first cover 110, and the foundation 126 may form a sixth compartment 140 that is adjacent to the fifth compartment 139 and separated by the partition 130.

In some embodiments, the first compartment 135, the second compartment 136, the third compartment 137, the fourth compartment 138, the fifth compartment 139, and/or the sixth compartment 140 may be individually accessible and/or jointly accessible from the exterior of the luggage piece 100 through one or more openings. For example, the first cover 110 may include one or more openings that may be opened and closed via zippers, clasps, snap buttons, or any other fasteners through which one or more of the first compartment 135, the second compartment 136, the third compartment 137, the fourth compartment 138, the fifth compartment 139, and/or the sixth compartment 140 in the interior space of the luggage piece 100 may be accessed. In these and other embodiments, the first compartment 135, the second compartment 136, the third compartment 137, the fourth compartment 138, the fifth compartment 139, and/or the sixth compartment 140 may be used, among other purposes, to store equipment used for fencing. For example, body cords and mask cords may be stored in the first compartment 135, while masks are placed in the second compartment 136, which may or may not be larger than the first compartment 135. Additionally or alternatively, jackets and knickers may be stored in the fourth compartment 138. Fencing equipment may be stored in ways that minimize damage and/or general wear-and-tear to different pieces of equipment by separating the various compartments in the first shell 120. For example, pieces of equipment that have previously been worn and are saturated in sweat may be separated from other pieces of equipment that include electrical wiring to prevent damaging the electrical wiring of the other pieces of equipment. As an additional or alternative example, a fencing mask may be stored separate from body cords and mask cords to prevent the metal mesh surface of the fencing mask from abrasively contacting the protective plastic or rubber coating of the body cords and/or mask cords.

In some embodiments, the partition 130, the first compartment separator 133, and/or the second compartment separator 134 may be attached to the first shell 120 in different locations and/or positions to change the shapes and/or sizes of the compartments 135-140. Shifting the position of the partition 130 along a width of the first shell 120, for example, may increase the sizes of some of the compartments 135-140 while decreasing the sizes of other compartments 135-140. In these and other embodiments, the first shell 120 may include notches, grooves, hook-and-loop fasteners, or any other features on one or more interior surfaces and/or along a perimeter of the first shell 120 that facilitate attachment of the partition 130, the first compartment separator 133, and/or the second compartment separator 134 within the interior space of the first shell 120. For example, the first lid 122, the back panel 124, the first cover 110, the foundation 126, and/or any other surfaces that form the interior space of the first shell 120 may include the one or more features that facilitate positioning and/or attachment of the partition 130, the first compartment separator 133, and/or the second compartment separator 134.

In some embodiments, the luggage piece 100 may include a second shell 102 positioned above the first shell 120. The second shell 102 may include a second lid 104 and a second cover 106. Additionally or alternatively, the back panel 124 may extend beyond a length corresponding to the first shell 120 such that the back panel 124 partially or entirely forms a surface of the second shell 102 as well. Accordingly, the second shell 102 may be defined by the back panel 124 and the second cover 106 for lateral surfaces of the second shell 102 and by the second lid 104 and the first lid 122 for base surfaces of the second shell 102.

The second shell 102 may include an interior space that functions as a seventh compartment 108. In some embodiments, the seventh compartment 108 may be separated from the first compartment 135, the second compartment 136, the third compartment 137, the fourth compartment 138, the fifth compartment 139, and/or the sixth compartment 140. Although the back panel 124 may be included as surfaces of both the first shell 120 and the second shell 102, the interior spaces of the first shell 120 and the second shell 102 may be separated by one or more dividing surfaces, such as the first lid 122.

Additionally or alternatively, the second shell 102 may include a pocket 150. The pocket 150 may include an opening, such as a first opening 152 and/or a second opening 154 along a top edge of the pocket 150 into which fencing equipment may be inserted. In some embodiments, the pocket 150 may extend along a length of the back panel 124 beyond the length of the second shell 102 itself by extending into the first shell 120. In these and other embodiments, the first lid 122 may include a slot 156 through which the pocket 150 extends into the interior space of the first shell 120. The length of the pocket 150 extending beyond the length of either the first shell 120 and/or the second shell 102 individually may facilitate storage of longer pieces of fencing equipment, such as fencing swords, by inserting the fencing equipment into the pocket 150 via the first opening 152 and/or the second opening 154.

In some embodiments, components of the luggage piece 100 may be constructed with a wide range of dimensions. For example, dimensions of the first shell 120 and/or the second shell 102 may be based, to varying degrees, on dimensions of the first lid 122, the back panel 124, the foundation 126, the first cover 110, the second cover 106, and/or the second lid 104. Additionally or alternatively, dimensions of the first compartment 135, the second compartment 136, the third compartment 137, the fourth compartment 138, the fifth compartment 139, the sixth compartment 140, and/or the seventh compartment 108 may be based, to varying degrees, on dimensions of the first shell 120, the second shell 102, the partition 130, the first compartment separator 133, and/or the second compartment separator 134.

In these and other embodiments, shapes and/or orientations of various components of the luggage piece 100 may be modified or changed in the scope of the present disclosure. For example, a curvature of the first cover 110 may be increased or decreased to respectively form a more bowed or flatter profile for the first shell 120 while maintaining a curved profile to facilitate storage of lames without folding electrically conductive portions of the lames. As an additional or alternative example, the shape and/or the orientation of the partition 130, the first compartment separator 133, and/or the second compartment separator 134 may be changed to form a different number of and/or differently shaped compartments within the interior space of the first shell 120.

In some embodiments, the first cover 110, the first shell 120, the first lid 122, the back panel 124, the second lid 104, or some combination thereof that defines part of or all of an outer surface of the luggage piece 100 may be made of a rigid or hard polymeric material, such as acrylonitrile butadiene styrene, high-density polyethylene, polyvinyl chloride, polystyrene, polypropylene, etc. Additionally or alternatively, some or all of the outer surface of the luggage piece 100 may be made of a metal material, such as aluminum and/or stainless steel. In these and other embodiments, the partition 130, the first compartment separator 133, the second compartment separator 134, the pocket 150, some combination thereof, or any other element or parts inside of the luggage piece 100 may be made of a more flexible material, such as nylon, leather, polyester, polypropylene, etc. Additionally or alternatively, the more flexible material may encase or otherwise cover a more rigid material that provides a more definite shape for elements of the luggage piece 100, such as the partition 130, the first compartment separator 133, and/or the second compartment separator 134. For example, wood, metal, hard plastic, or any other rigid material may be used to form a wall that protrudes into the interior of the luggage piece 100 to form the partition 130, and a softer material may be used to wrap the partition 130.

Figure 2:
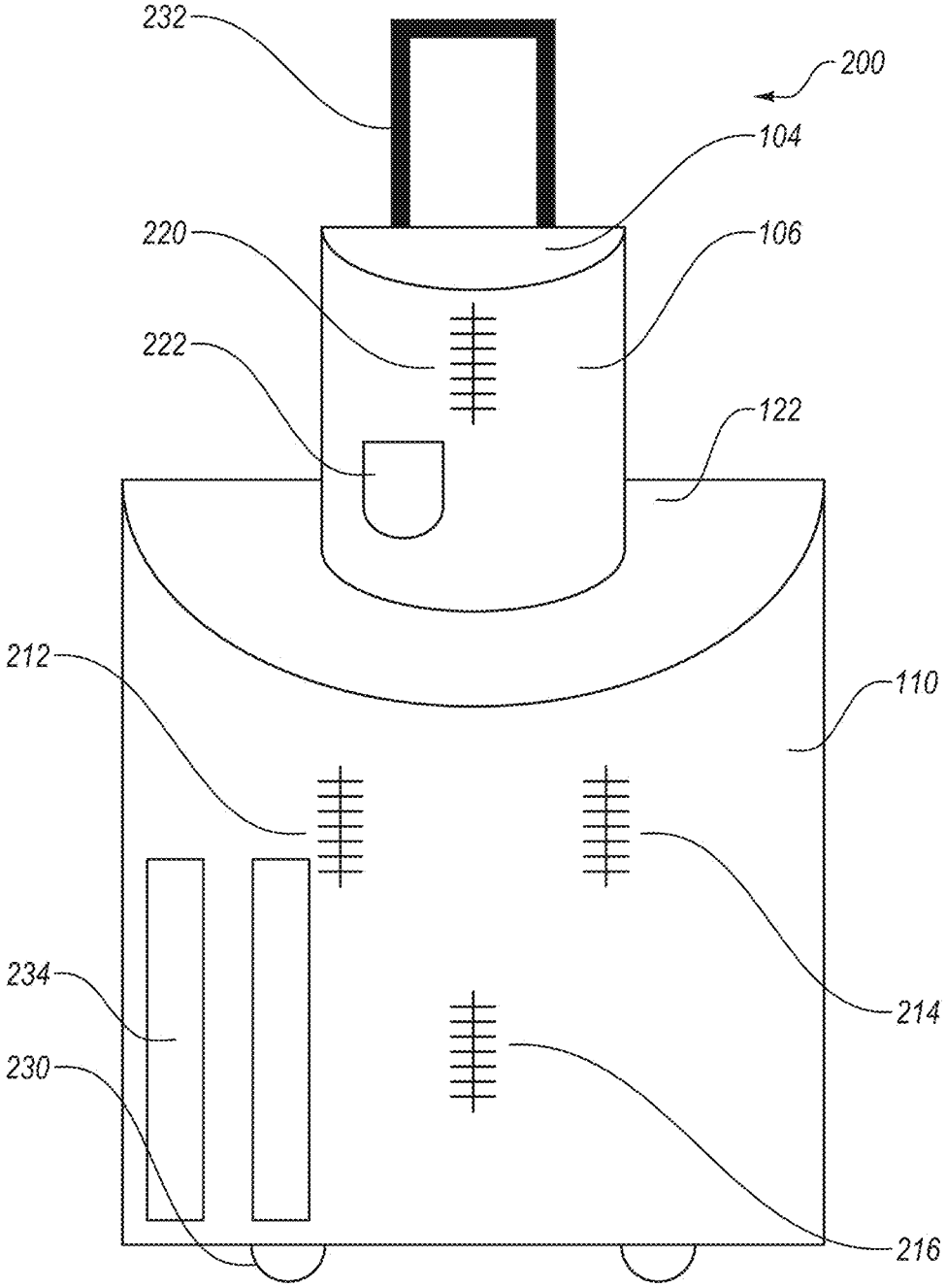
FIG. 2 illustrates a first front perspective view of the luggage piece according to one or more embodiments of the present disclosure.

FIG. 2 illustrates a first front perspective view 200 of the luggage piece 100 according to one or more embodiments of the present disclosure. The front perspective view 200 of the luggage piece 100 illustrates the first shell 120 with the first cover 110 in which the first cover 110 is closed. As illustrated, the second shell 102 may be positioned above the first shell 120 against a top surface of the first lid 122. The second shell 102 may be enclosed by a second cover 106 oriented to cover a lateral surface of the second shell 102, and the second lid 104 may form a surface that covers a top of the second shell 102.

The front perspective view 200 depicts the curved shape of the first cover 110 as the luggage piece 100 stands upright on the foundation 126 (not shown in the front perspective view 200) and the half-cylindrical shape of the luggage piece 100. The front perspective view 200 additionally or alternatively depicts the second cover 106 of the second shell 102 including a curved shape similar to the curved shape of the first cover 110. Although illustrated as having a curved shape, the second cover 106 may include one or more straight edges, one or more flatter surfaces, or any other profiles. Additionally or alternatively, the second shell 102 may include a shape different from the shape of the first shell 120 due to differences in the shaping, contouring, and/or sizing of the back panel 124 (not shown in the front perspective view 200) and/or of the second cover 106 relative to the first cover 110.

The front perspective view 200 illustrates, in some embodiments, that the first cover 110 may include one or more sealable holes 212, 214, and/or 216 to facilitate compartmentalized access to one or more of the first compartment 135, the second compartment 136, the third compartment 137, the fourth compartment 138, the fifth compartment 139, and/or the sixth compartment 140 without needing to open the first cover 110 itself. The second cover 106 may include a sealable hole 220 to facilitate access to the interior space of the second shell 102 and/or one or more pouches, such as pouch 222, for more storage options. In some embodiments, one or more of the sealable holes 212, 214, 216, and/or 220 may include openings that may be opened or fastened close, such as by a zipper mechanism, a hook-and-loop fastener, a snap button, some combination thereof, or any other mechanism. In these and other embodiments, the pouch 222 may form a discrete space in which additional pieces of fencing equipment or other items may be stored. Although the sealable holes 212, 214, and 216 are illustrated as being positioned along a surface of the first cover 110, the sealable hole 220 is illustrated as being positioned along a surface of the second cover 106, and the pouch 222 is illustrated as being positioned along the surface of the second cover 106, one or more of the sealable holes 212, 214, 216, and/or 220 and/or the pouch 222 may be positioned on any surface of the luggage piece 100. Additionally or alternatively, more or fewer sealable holes and/or pouches may be implemented with the luggage piece 100 than the sealable holes 212, 214, 216, and 220 and the pouch 222 illustrated in the front perspective view 200 of the luggage piece 100.

The luggage piece 100 may be transported and handled in several ways based on how a user stores fencing equipment in the luggage piece 100. In some embodiments, for example, the luggage piece 100 may include wheels 230 attached to a bottom surface of the foundation 126 (not shown) such that the luggage piece 100 may be moved in an upright position as depicted by the front perspective view 200. In these and other embodiments, a retractable handle 232 may be positioned along an exterior surface of the back panel 124 such that the retractable handle 232 extends above the second lid 104 such that the luggage piece 100 may be pulled and moved in the upright position. Additionally or alternatively, one or more straps 234 may be attached to exterior surfaces of the luggage piece 100 to facilitate carrying the luggage piece 100 in a variety of sideways orientations. For example, the first cover 110 may include the straps 234 that allow a user to carry the luggage piece 100 horizontally and parallel to the ground. As an additional or alternative example, the straps 234 may be positioned along the back panel 124 of the luggage piece 100, the second cover 106, or any other surface of the luggage piece 100. Although the straps 234 are illustrated as two straps that span approximately half of a length of the first cover 110, the straps 234 may include any number of straps and may be shaped and/or sized differently than as illustrated in the front perspective view 200.

Figure 3A:
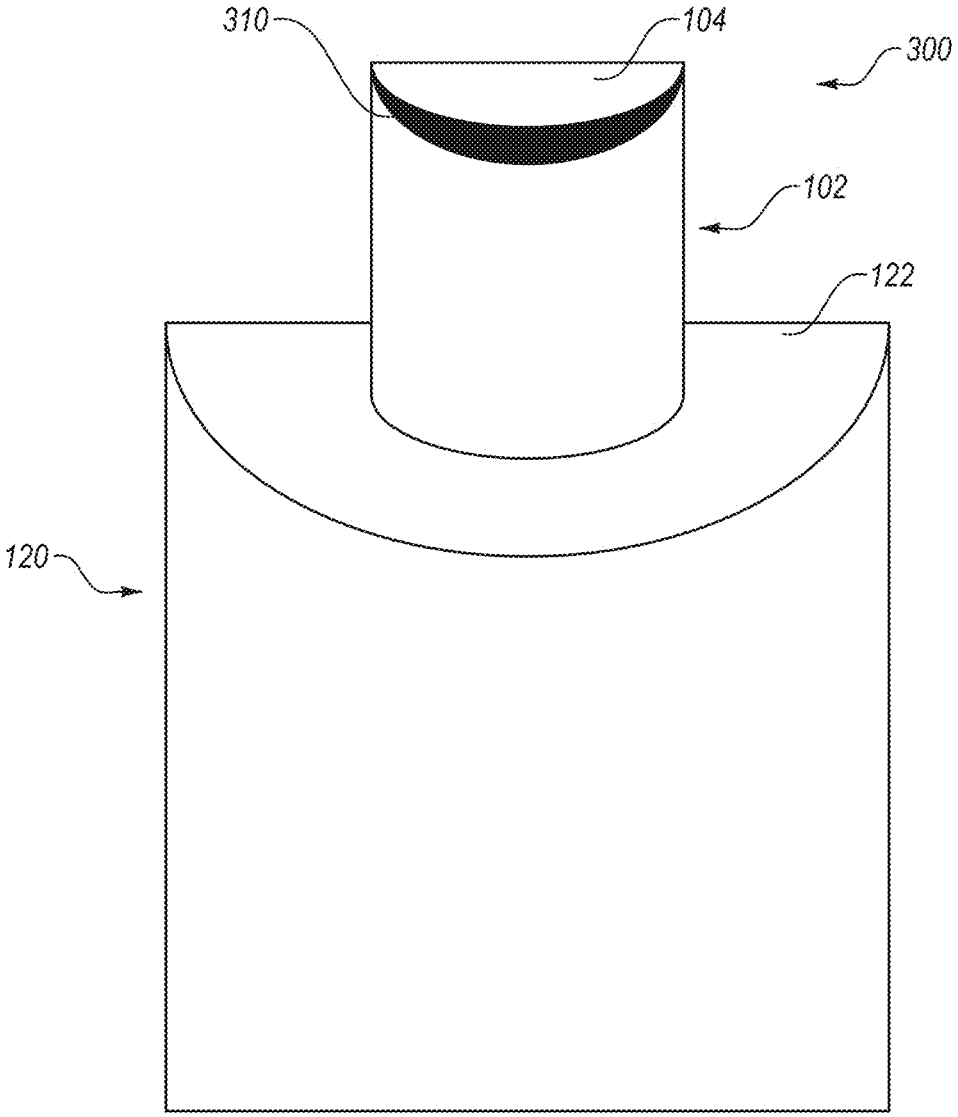
FIG. 3A illustrates a second front perspective view of the luggage piece including an opening in a first lid section according to at least one embodiment of the present disclosure.

FIG. 3A illustrates a second front perspective view 300 of the luggage piece 100 in which the second lid 104 is opened according to at least one embodiment of the present disclosure. The second lid 104 may be opened and/or closed using a zipper, clasps, hook-and-loop fasteners, some combination thereof, or any other fasteners. Additionally or alternatively, the second lid 104 may or may not include a mechanism for opening and closing the second lid 104 along any edge of the second lid 104, instead allowing a user to access the interior of the second shell 102 via the sealable hole 220.

Figure 3B:
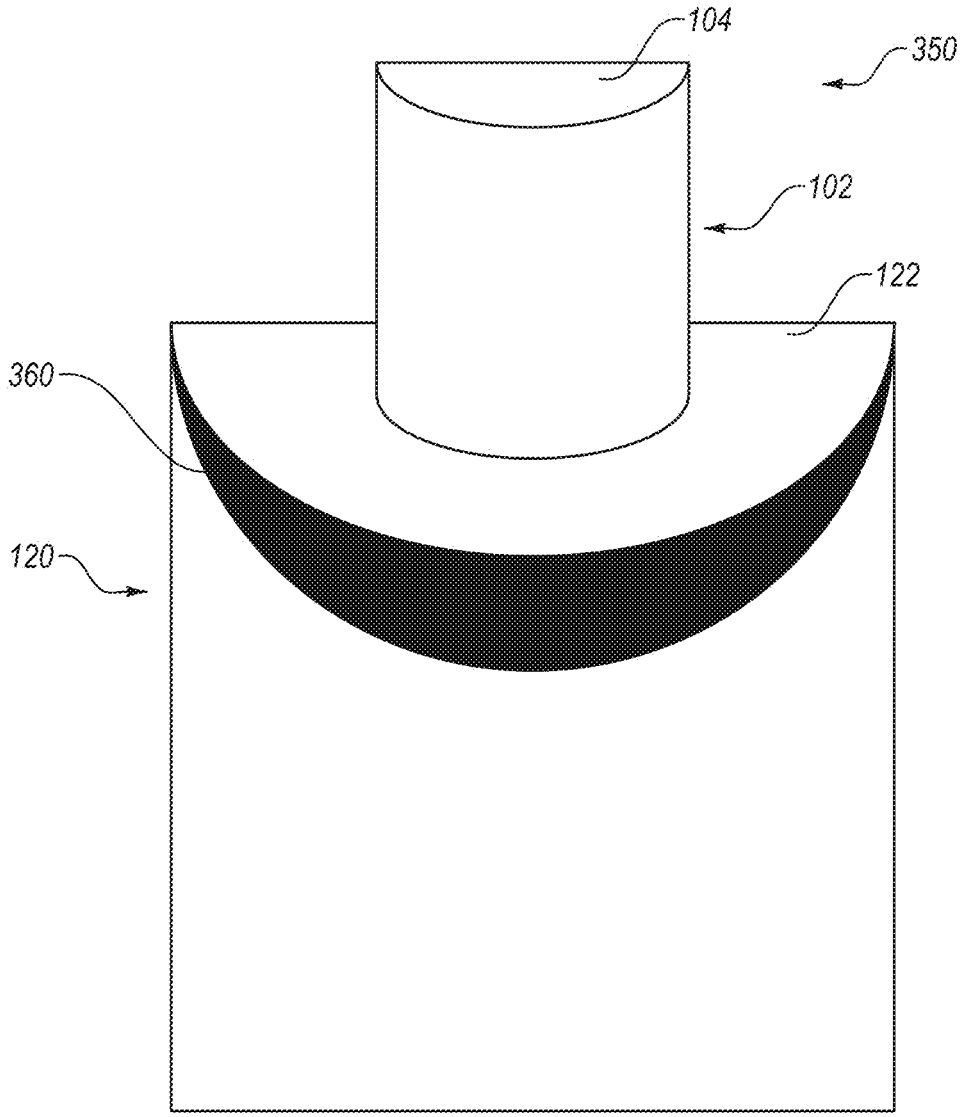
FIG. 3B illustrates the second front perspective view of the luggage piece including an opening in a second lid section according to at least one embodiment of the present disclosure.

FIG. 3B illustrates a third front perspective view 350 of the luggage piece 100 in which the first lid 122 is opened according to at least one embodiment of the present disclosure. As illustrated in the third front perspective view 350, the first lid 122 may be opened and/or closed using a zipper, clasps, hook-and-loop fasteners, some combination thereof, or any other fasteners in a similar manner as the second lid 104. In some embodiments, the first lid 122 may be made of a soft and/or flexible material to facilitate opening the first lid 122. Unlike the second lid 104, the second shell 102 may be positioned flush against and on top of the first lid 122 such that opening and/or closing the first lid 122 may be obstructed by the second shell 102. By using a soft and/or flexible material for the first lid 122, such as a fabric or synthetic polymer, the first lid 122 may be opened more easily despite the second shell 102 attached on top of the first lid 122.

Figure 4:
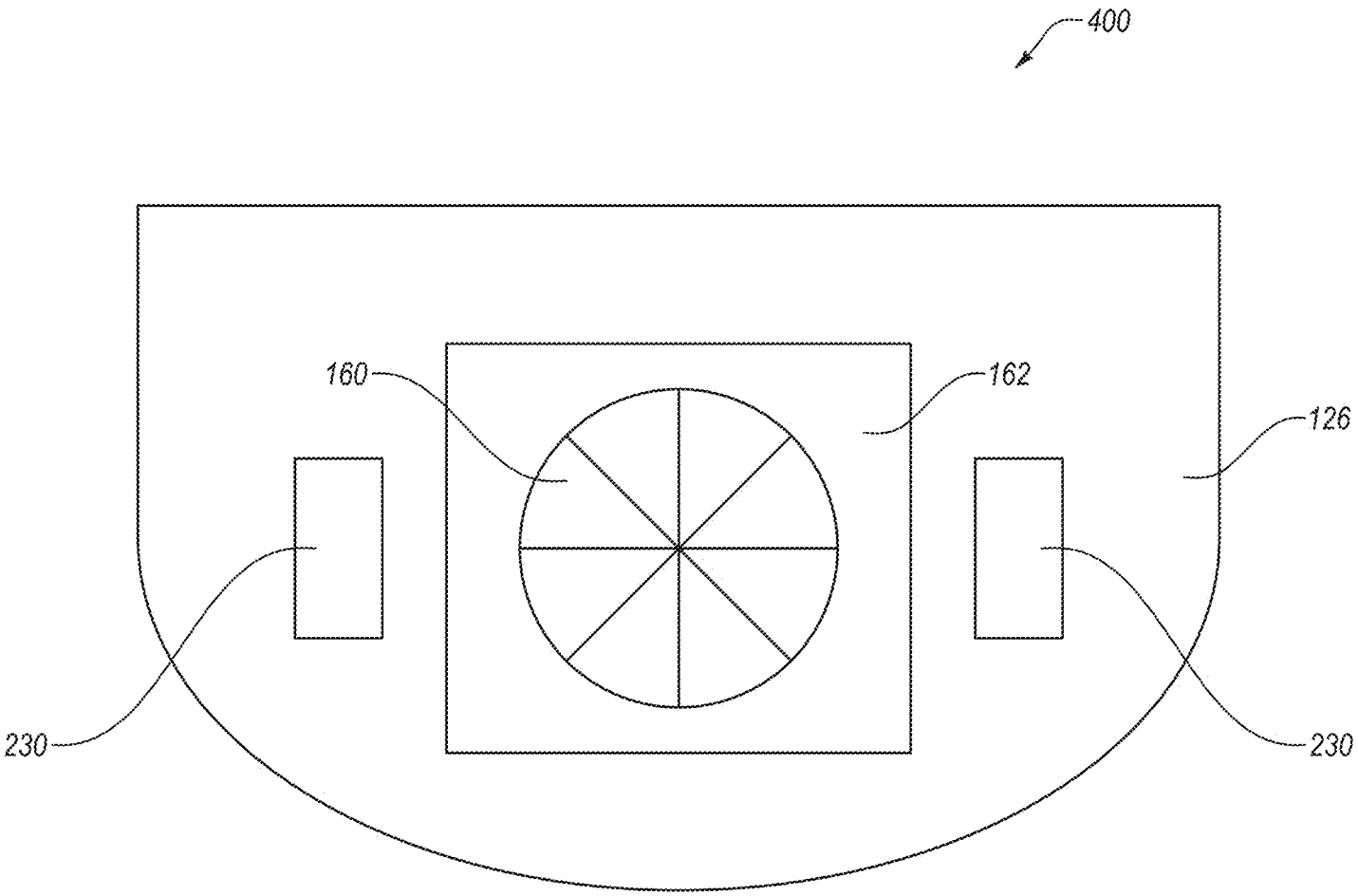
FIG. 4 illustrates a side perspective view of the luggage piece according to at least one embodiment of the present disclosure.

FIG. 4 illustrates a bottom-up perspective view 400 of the luggage piece 100 according to at least one embodiment of the present disclosure. As seen in the bottom-up perspective view 400, a fan 160 may be inset in the foundation 126 of the luggage piece 100. The fan 160 may be positioned in an opening in the foundation 126 that connects a space exterior to the first shell 120 and the second shell 102 to the interior spaces of the first shell 120 and of the second shell 102. The fan 160 may facilitate air flow and ventilation for one or more of the first compartment 135, the second compartment 136, the third compartment 137, the fourth compartment 138, the fifth compartment 139, the sixth compartment 140, and/or the seventh compartment 108. The fan 160 may be configured to be connected to an electrical outlet via a detachable electrical cord that may be stored in any of the compartments 108 and 135-140 in the luggage piece 100 such that the fan 160 is electrically powered and can independently generate air flow for the interior space of the luggage piece 100. Additionally or alternatively, the fan 160 may be coupled to the wheels 230 of the luggage piece 100 such that using the wheels 230 to move the luggage piece 100 causes the fan 160 to rotate and promote air flow in the interior space of the luggage piece 100. Although the bottom-up perspective view 400 includes two wheels 230, it is understood that fewer or more wheels 230 may be attached to the luggage piece 100 on the foundation 126. For example, three, four, five, or more wheels 230 may be attached to the foundation 126. As an additional or alternative example, a single wheel 230 or no wheels at all may be attached to the foundation 126.

In some embodiments, the fan 160 may be separated from any of the compartments 108 and 135-140 by a grille 162. Separating the fan 160 from the interior space of the luggage piece 100 may prevent any items stored inside of the luggage piece 100 from being damaged by the rotating fan 160. In these and other embodiments, the grille 162 may be made of a polymeric plastic material, such as polyvinyl chloride or high-density polyethylene, a metal material, such as iron, some combination thereof, or any other rigid material that can maintain its shape to prevent interfering with the rotation of the fan 160.

Figure 5:
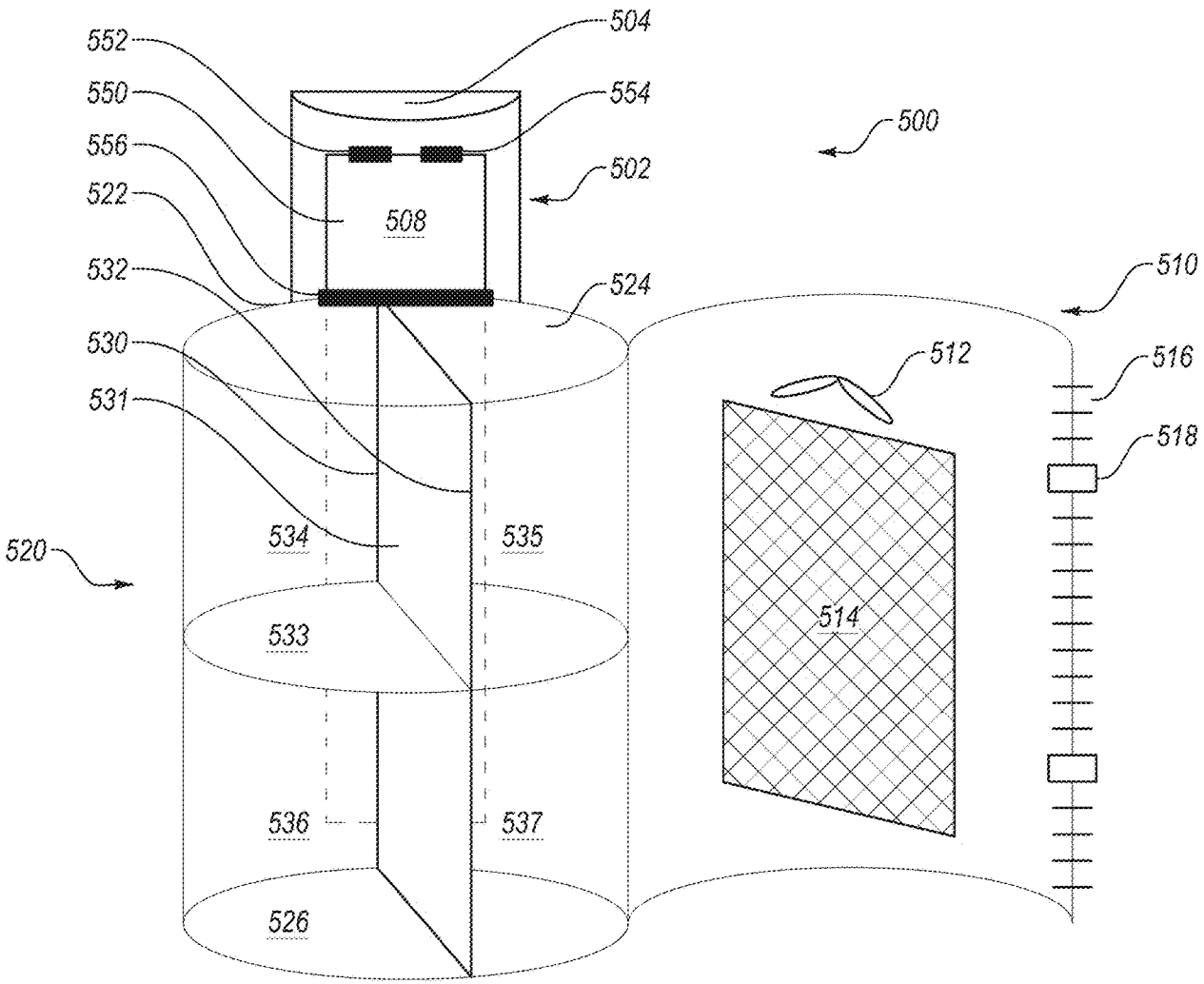
FIG. 5 illustrates a top-down perspective view of the luggage piece according to at least one embodiment of the present disclosure.

FIG. 5 illustrates an interior view of a luggage piece 500 according to one or more embodiments of the present disclosure. The luggage piece 500 may include a first shell 520 that includes an interior space formed by a first lid 522, a first cover 510, a back panel 524, and a foundation 526. In some embodiments, the first lid 522 may be the same as or substantially similar to the first lid 122 described in relation to the luggage piece 100. Additionally or alternatively, the first cover 510 may be the same as or substantially similar to the first cover 110 described in relation to the luggage piece 100. Additionally or alternatively, the back panel 524 may be the same as or substantially similar to the back panel 124 described in relation to the luggage piece 100. Additionally or alternatively, the foundation 526 may be the same as or substantially similar to the foundation 126 described in relation to the luggage piece 100.

A partition 530 and a compartment separator 533 may be positioned inside of the interior space of the first shell 520 to form a first compartment 534, a second compartment 535, a third compartment 536, and a fourth compartment 537 inside of the first shell 520. In some embodiments, the first compartment 534 may be formed by the first lid 522, the first cover 510, the back panel 524, the compartment separator 533, and a first side 531 of the partition 530. The second compartment 535 may be formed by the first lid 522, the first cover 510, the back panel 524, the compartment separator 533, and a second side 532 of the partition 530. The third compartment 536 may be formed by the compartment separator 533, the first cover 510, the back panel 524, the foundation 526, and the first side 531 of the partition 530. The fourth compartment 537 may be formed by the compartment separator 533, the first cover 510, the back panel 524, the foundation 526, and the second side 531 of the partition 530.

In some embodiments, the partition 530 may or may not be the same as or substantially similar to the partition 130 described in relation to the luggage piece 100 in that a position, orientation, and/or shape of the partition 530 may be adjusted to affect a corresponding adjustment to the shapes and/or sizes of the first compartment 534, the second compartment 535, the third compartment 536, and/or the fourth compartment 537. As illustrated in FIG. 5, for example, the partition 530 may be positioned closer to a center with respect to the interior space of the first shell 520 relative to the partition 130 as illustrated in FIG. 1 with respect to the first shell 120. Additionally or alternatively, the compartment separator 533 may be positioned, oriented, and/or shaped similarly to or differently from one of the first compartment separator 133 and/or the second compartment separator 134 as illustrated in FIG. 1 in relation to the first shell 120 of the luggage piece 100.

The luggage piece 500 may include a second shell 502 formed by at least a portion of the first lid 522 as a bottom surface and a second lid 504 as a top surface with the back panel 524 connecting the first lid 522 to the second lid 504. A second cover 506, along with the first lid 522, the back panel 524, and the second lid 504, may enclose an interior space of the second shell 502 to form a fifth compartment 508. In some embodiments, the second shell 502 and the fifth compartment 508 may be the same as or substantially similar to the second shell 102 and the seventh compartment 108, respectively, described in relation to the luggage piece 100. For example, a pocket 550 may be included in the fifth compartment 508, positioned against the back panel 524, and extend into the first shell 520 through a slot 556. The pocket 550 may include one or more openings, such as a first opening 552 and a second opening 554, into which fencing equipment, such as fencing swords, may be inserted for storage in the luggage piece 500.

Figure 6:
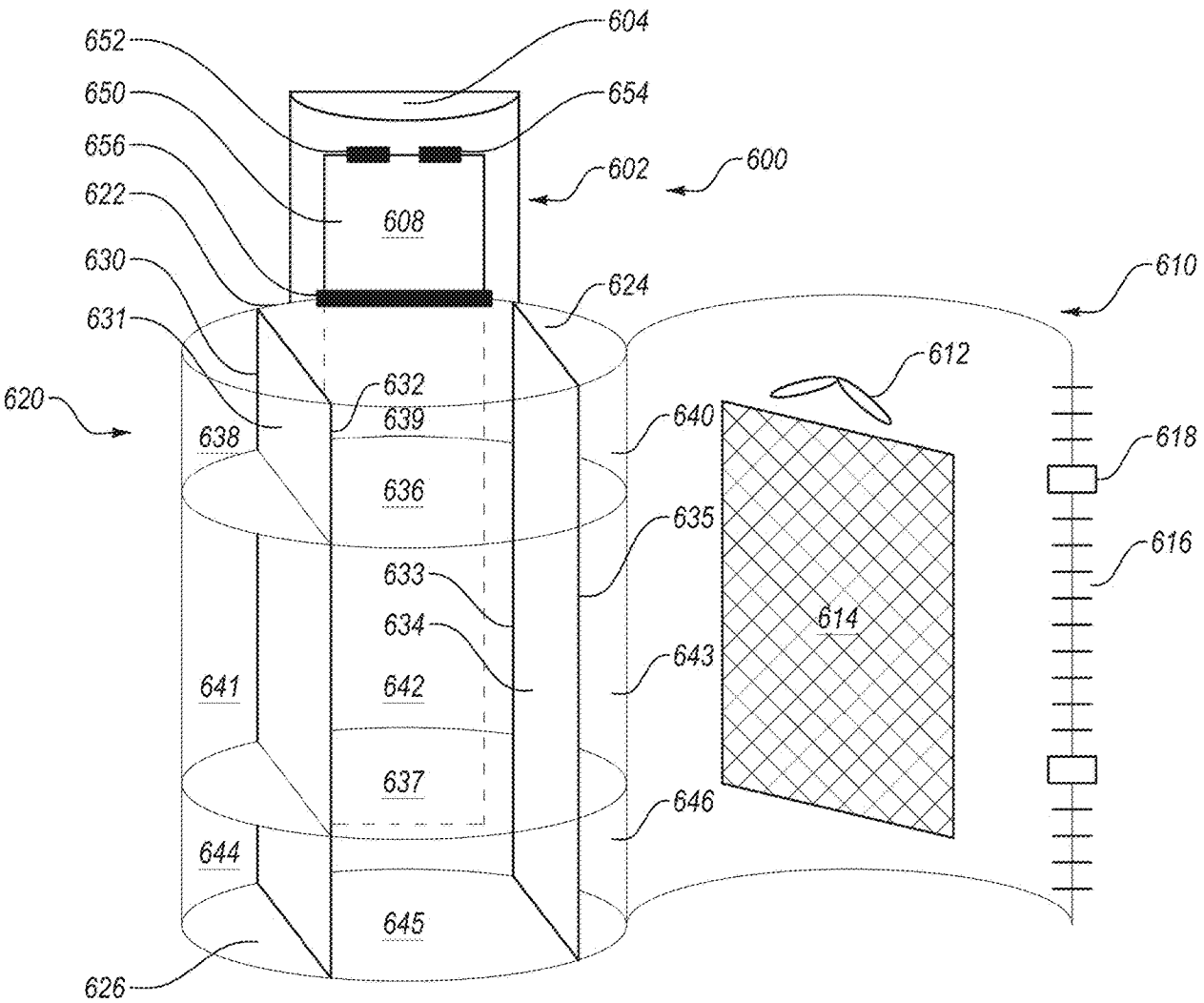
FIG. 6 illustrates a bottom-up perspective view of the luggage piece according to at least one embodiment of the present disclosure.

FIG. 6 illustrates an interior view of a luggage piece 600 according to one or more embodiments of the present disclosure. The luggage piece 600 may include a first shell 620 that includes an interior space formed by a first lid 622, a first cover 610, a back panel 624, and a foundation 626. A first partition 630, a second partition 633, a first compartment separator 636, and a second compartment separator 637 may be positioned inside of the interior space of the first shell 620 to form a first compartment 638, a second compartment 639, a third compartment 640, a fourth compartment 641, a fifth compartment 642, a sixth compartment 643, a seventh compartment 644, an eighth compartment 645, and a ninth compartment 646 inside of the first shell 620. In some embodiments, the first lid 622 may be the same as or substantially similar to the first lid 122 described in relation to the luggage piece 100. Additionally or alternatively, the first cover 610 may be the same as or substantially similar to the first cover 110 described in relation to the luggage piece 100. Additionally or alternatively, the back panel 624 may be the same as or substantially similar to the back panel 124 described in relation to the luggage piece 100. Additionally or alternatively, the foundation 626 may be the same as or substantially similar to the foundation 126 described in relation to the luggage piece 100.

In some embodiments, the first compartment 638 may be formed by the first lid 622, the back panel 624, the first cover 610, the first compartment separator 636, and a first side 631 of the first partition 630. The second compartment 639 may be formed by the first lid 622, the back panel 624, the first cover 610, the first compartment separator 636, a second side 632 of the first partition 630, and a first side 634 of the second partition 633. The third compartment 640 may be formed by the first lid 622, the back panel 624, the first cover 610, the first compartment separator 636, and a second side 635 of the second partition 633.

In these and other embodiments, the fourth compartment 641 may be formed by the first compartment separator 636, the back panel 624, the first cover 610, the second compartment separator 637, and the first side 631 of the first partition 630. The fifth compartment 642 may be formed by the first compartment separator 636, the back panel 624, the first cover 610, the second compartment separator 637, the second side 632 of the first partition 630, and the first side 634 of the second partition 633. The sixth compartment 643 may be formed by the first compartment separator 636, the back panel 624, the first cover 610, the second compartment separator 637, and the second side 635 of the second partition 633.

In these and other embodiments, the seventh compartment 644 may be formed by the second compartment separator 637, the back panel 624, the first cover 610, the foundation 626, and the first side 631 of the first partition 630. The eighth compartment 645 may be formed by the second compartment separator 637, the back panel 624, the first cover 610, the foundation 626, the second side 632 of the first partition 630, and the first side 634 of the second partition 633. The ninth compartment 645 may be formed by the second compartment separator 637, the back panel 624, the first cover 610, the foundation 626, and the second side 635 of the second partition 633.

In some embodiments, the first partition 630 and/or the second partition 633 may or may not be the same as or substantially similar to the partition 130 described in relation to the luggage piece 100. For example, the first partition 630 may be positioned, oriented, and/or shaped the same as or substantially similar to the partition 130. The second partition 633, which may or may not be oriented and/or shaped the same as or substantially similar to the partition 130, may be positioned parallel to the first partition 630. Additionally or alternatively, the first compartment separator 636 and/or the second compartment separator 637 may be positioned, oriented, and/or shaped similarly to or differently from the first compartment separator 133 and/or the second compartment separator 134 as illustrated in FIG. 1 in relation to the first shell 120 of the luggage piece 100.

Like the luggage piece 500 and/or the luggage piece 100, the luggage piece 600 may include a second shell 602 formed by at least a portion of the first lid 622, a second lid 604, the back panel 624, and a second cover 606 that enclose an interior space of the second shell 602 to form a tenth compartment 608. The second shell 602 and the tenth compartment 608 may respectively be the same as or substantially similar to the second shell 102 and the seventh compartment 108 or the second shell 502 and the fifth compartment 508 as described in relation to the luggage piece 100 and the luggage piece 500, respectively. Like with the luggage piece 100 and the luggage piece 500, a pocket 650 may be included in the tenth compartment 608, positioned against the back panel 624, and extend into the first shell 620 through a slot 656. The pocket 650 may include one or more openings, such as a first opening 652 and a second opening 654, into which fencing equipment may be inserted for storage in the luggage piece 600.

A luggage piece may include a first shell formed by a back panel, a first cover, a first lid, and a foundation in which the back panel, the first cover, the first lid section, and the foundation define an interior space of the first shell. The first cover may include a curved profile shape that bows out relative to the interior space of the first shell. A first compartment within the interior space of the first shell may be defined by the back panel, a first surface of a partition positioned inside of the interior space of the first shell, a compartment separator, the first cover, and the first lid. A second compartment within the interior space of the first shell may be defined by the back panel, a second surface of the partition, the compartment separator, the first cover, and the first lid. A third compartment within the interior space of the first shell may be defined by the back panel, the first surface of the partition, the compartment separator, the first cover, and the foundation. A fourth compartment within the interior space of the first shell may be defined by the back panel, the second surface of the partition, the compartment separator, the first cover, and the foundation. A second shell may be formed by the back panel, a second cover, a second lid, and the first lid in which the back panel, the second cover, the second lid, and the first lid define an interior space of the second shell, the interior space of the second shell demarcating a fifth compartment.

The first cover of the luggage piece may include a curved hanger fixed to an interior surface of the first cover.

The first cover of the luggage piece may further include a mesh net fixed to the interior surface of the first cover.

The back panel of the luggage piece may include a first panel section that corresponds to a first portion of the back panel defining a back surface of the first compartment and a second panel section that corresponds to a second portion of the back panel defining a back surface of the second compartment. The first panel section may have a greater surface area than the second panel section. In some embodiments, the back panel may further include a pocket attached to the interior surface of the back panel in which the pocket spans a length greater than a first length corresponding to the first panel section and a second length corresponding to the second panel section. In some embodiments, the length of the pocket may be greater than a length of a fencing sword.

The luggage piece may further include a fan positioned in the foundation section in which the fan provides an opening connecting a space exterior to the first shell and the second shell to the interior space of the first shell and the interior space of the second shell.

A luggage piece may include a first shell formed by a back panel, a first cover, a first lid, and a foundation in which the back panel, the first cover, the first lid section, and the foundation define an interior space of the first shell. The first cover may include a curved profile shape that bows out relative to the interior space of the first shell. A second shell may be formed by the back panel, a second cover, a second lid, and the first lid in which the back panel, the second cover, the second lid, and the first lid define an interior space of the second shell. The luggage piece may include a partition positioned inside of the interior space of the first shell. The luggage piece may include a first compartment separator positioned in the interior space of the first shell with the first compartment separator being positioned perpendicular to and intersecting the partition. The luggage piece may include a second compartment separator positioned in the interior space of the first shell in which the second compartment separator is positioned perpendicular to and intersecting the partition and parallel to the first compartment separator. A first compartment within the interior space of the first shell may be defined by the back panel, a first surface of the partition, the first compartment separator, the first cover, and the first lid. A second compartment within the interior space of the first shell may be defined by the back panel, a second surface of the partition, the first compartment separator, the first cover, and the first lid. A third compartment within the interior space of the first shell may be defined by the back panel, the first compartment separator, the first surface of the partition, the second compartment separator, and the first cover. A fourth compartment within the interior space of the first shell may be defined by the back panel, the first compartment separator, the second surface of the partition, the second compartment separator, and the first cover. A fifth compartment within the interior space of the first shell may be defined by the back panel, the second compartment separator, the first surface of the partition, a compartment floor, and the first cover. A sixth compartment within the interior space of the first shell may be defined by the back panel, the second compartment separator, the second surface of the partition, the compartment floor, and the first cover. A seventh compartment may be defined by the interior space of the second shell.

The first cover of the luggage piece may include a curved hanger fixed to an interior surface of the first cover. The first cover may further include a mesh net fixed to the interior surface of the first cover.

The back panel of the luggage piece may include a first panel section that corresponds to a first portion of the back panel defining a back surface of the first compartment, the second compartment, the third compartment, the fourth compartment, the fifth compartment, and the sixth compartment. Additionally or alternatively, the back panel may include a second panel section that corresponds to a second portion of the back panel defining a back surface of the seventh compartment. In some embodiments, the first panel section may have a greater surface area than the second panel section. The back panel may further include a pocket attached to the interior surface of the back panel in which the pocket may span a length greater than a first length corresponding to the first panel section and a second length corresponding to the second panel section. In some embodiments, the length of the pocket may be greater than a length of a fencing sword.

The luggage piece may include a fan positioned in the foundation section in which the fan provides an opening connecting a space exterior to the first shell and the second shell to the interior space of the first shell and the interior space of the second shell.

A luggage piece may include a first shell formed by a back panel, a first cover, a first lid, and a foundation in which the back panel, the first cover, the first lid section, and the foundation define an interior space of the first shell. The first cover may include a curved profile shape that bows out relative to the interior space of the first shell. A second shell may be formed by the back panel, a second cover, a second lid, and the first lid in which the back panel, the second cover, the second lid, and the first lid define an interior space of the second shell. A first partition and a second partition may be positioned inside of the interior space of the first shell in which the second partition being positioned parallel to the first partition. A first compartment separator may be positioned in the interior space of the first shell in which the first compartment separator is positioned perpendicular to and intersecting the first partition and the second partition. A second compartment separator may be positioned in the interior space of the first shell parallel to the first compartment separator in which the second compartment separator is positioned perpendicular to and intersecting the first partition and the second partition. The first partition, the second partition, the first compartment separator, and the second compartment separator may form a first compartment within the interior space of the first shell defined by the back panel, a first surface of the first partition, the first compartment separator, the first cover, and the first lid; a second compartment within the interior space of the first shell defined by the back panel, a second surface of the first partition, the first compartment separator, a first surface of the second partition, the first cover, and the first lid; a third compartment within the interior space of the first shell defined by the back panel, the first compartment separator, a second surface of the second partition, and the first cover; a fourth compartment within the interior space of the first shell defined by the back panel, the first compartment separator, the first surface of the first partition, the second compartment separator, and the first cover; a fifth compartment within the interior space of the first shell defined by the back panel, the first compartment separator, the second surface of the first partition, the second compartment separator, the first surface of the second partition, and the first cover; a sixth compartment within the interior space of the first shell defined by the back panel, the first compartment separator, the second compartment separator, the second surface of the second partition, and the first cover; a seventh compartment within the interior space of the first shell defined by the back panel, the second compartment separator, the first surface of the first partition, a compartment floor, and the first cover; an eighth compartment within the interior space defined by the back panel, the second compartment separator, the second surface of the first partition, the first surface of the second partition, the compartment floor, and the first cover; and a ninth compartment within the interior space defined by the back panel, the second compartment separator, the second surface of the second partition, the compartment floor, and the first cover. A tenth compartment may be defined by the interior space of the second shell.

The back panel of the luggage piece may include a first panel section that corresponds to a first portion of the back panel defining a back surface of the first compartment, the second compartment, the third compartment, the fourth compartment, the fifth compartment, the sixth compartment, the seventh compartment, the eighth compartment, and the ninth compartment. The back panel may include a second panel section that corresponds to a second portion of the back panel defining a back surface of the tenth compartment. The first panel section may have a greater surface area than the second panel section. In some embodiments, the back panel may further include a pocket attached to the interior surface of the back panel, the pocket spanning a length greater than a first length corresponding to the first panel section and a second length corresponding to the second panel section. In some embodiments, the length of the pocket may be greater than a length of a fencing sword.

Terms used in the present disclosure and especially in the appended claims (e.g., bodies of the appended claims) are generally intended as "open terms" (e.g., the term "including" should be interpreted as "including, but not limited to.").

Additionally, if a specific number of an introduced claim recitation is intended, such as intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is expressly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase preceding two or more alternative terms, whether in the description, claims, or drawings, should be understood to contemplate the possibilities of including one of the terms, either of the terms, or both of the terms. For example, the phrase "A or B" should be understood to include the possibilities of "A" or "B" or "A and B."

All examples and conditional language recited in the present disclosure are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, various changes, substitutions, and alterations could be made herein without departing from the spirit and scope of the present disclosure.

What is claimed is:

1. A luggage piece, comprising:

a first shell formed by a back panel, a first cover, a first lid, and a foundation in which the back panel, the first cover, the first lid section, and the foundation define an interior space of the first shell, wherein the first cover includes a curved profile shape that bows out relative to the interior space of the first shell;

a first compartment within the interior space of the first shell, the first compartment being defined by the back panel, a first surface of a partition positioned inside of the interior space of the first shell, a compartment separator, the first cover, and the first lid;

a second compartment within the interior space of the first shell, the second compartment being defined by the back panel, a second surface of the partition, the compartment separator, the first cover, and the first lid;

a third compartment within the interior space of the first shell, the third compartment being defined by the back panel, the first surface of the partition, the compartment separator, the first cover, and the foundation;

a fourth compartment within the interior space of the first shell, the fourth compartment being defined by the back panel, the second surface of the partition, the compartment separator, the first cover, and the foundation; and a second shell formed by the back panel, a second cover, a second lid, and the first lid in which the back panel, the second cover, the second lid, and the first lid define an interior space of the second shell, the interior space of the second shell demarcating a fifth compartment.

2. The luggage piece of claim 1, wherein the first cover includes a curved hanger fixed to an interior surface of the first cover.

3. The luggage piece of claim 1, wherein the first cover further includes a mesh net fixed to the interior surface of the first cover.

4. The luggage piece of claim 1, wherein the back panel comprises:

a first panel section that corresponds to a first portion of the back panel defining a back surface of the first compartment; and a second panel section that corresponds to a second portion of the back panel defining a back surface of the second compartment, the first panel section having a greater surface area than the second panel section.

5. The luggage piece of claim 4, wherein the back panel further comprises a pocket attached to the interior surface of the back panel, the pocket spanning a length greater than a first length corresponding to the first panel section and a second length corresponding to the second panel section.

6. The luggage piece of claim 5, wherein the length of the pocket is greater than a length of a fencing sword.

7. The luggage piece of claim 1, further comprising a fan positioned in the foundation section, the fan providing an opening connecting a space exterior to the first shell and the second shell to the interior space of the first shell and the interior space of the second shell.

8. A luggage piece, comprising:

a first shell formed by a back panel, a first cover, a first lid, and a foundation in which the back panel, the first cover, the first lid section, and the foundation define an interior space of the first shell, wherein the first cover includes a curved profile shape that bows out relative to the interior space of the first shell;

a second shell formed by the back panel, a second cover, a second lid, and the first lid in which the back panel, the second cover, the second lid, and the first lid define an interior space of the second shell;

a partition positioned inside of the interior space of the first shell;

a first compartment separator positioned in the interior space of the first shell, the first compartment separator being positioned perpendicular to and intersecting the partition; and a second compartment separator positioned in the interior space of the first shell, the second compartment separator being positioned perpendicular to and intersecting the partition and parallel to the first compartment separator, wherein:

a first compartment within the interior space of the first shell is defined by the back panel, a first surface of the partition, the first compartment separator, the first cover, and the first lid;

a second compartment within the interior space of the first shell is defined by the back panel, a second surface of the partition, the first compartment separator, the first cover, and the first lid;

a third compartment within the interior space of the first shell is defined by the back panel, the first compartment separator, the first surface of the partition, the second compartment separator, and the first cover;

a fourth compartment within the interior space of the first shell is defined by the back panel, the first compartment separator, the second surface of the partition, the second compartment separator, and the first cover;

a fifth compartment within the interior space of the first shell is defined by the back panel, the second compartment separator, the first surface of the partition, a compartment floor, and the first cover;

a sixth compartment within the interior space of the first shell is defined by the back panel, the second compartment separator, the second surface of the partition, the compartment floor, and the first cover; and a seventh compartment is defined by the interior space of the second shell.

9. The luggage piece of claim 8, wherein the first cover includes a curved hanger fixed to an interior surface of the first cover.

10. The luggage piece of claim 8, wherein the first cover further includes a mesh net fixed to the interior surface of the first cover.

11. The luggage piece of claim 8, wherein the back panel comprises:

a first panel section that corresponds to a first portion of the back panel defining a back surface of the first compartment, the second compartment, the third compartment, the fourth compartment, the fifth compartment, and the sixth compartment; and a second panel section that corresponds to a second portion of the back panel defining a back surface of the seventh compartment, the first panel section having a greater surface area than the second panel section.

12. The luggage piece of claim 11, wherein the back panel further comprises a pocket attached to the interior surface of the back panel, the pocket spanning a length greater than a first length corresponding to the first panel section and a second length corresponding to the second panel section.

13. The luggage piece of claim 12, wherein the length of the pocket is greater than a length of a fencing sword.

14. The luggage piece of claim 8, further comprising a fan positioned in the foundation section, the fan providing an opening connecting a space exterior to the first shell and the second shell to the interior space of the first shell and the interior space of the second shell.

15. A luggage piece, comprising:

a first shell formed by a back panel, a first cover, a first lid, and a foundation in which the back panel, the first cover, the first lid section, and the foundation define an interior space of the first shell, wherein the first cover includes a curved profile shape that bows out relative to the interior space of the first shell;

a second shell formed by the back panel, a second cover, a second lid, and the first lid in which the back panel, the second cover, the second lid, and the first lid define an interior space of the second shell;

a first partition positioned inside of the interior space of the first shell;

a second partition positioned inside of the interior space of the first shell, the second partition being positioned parallel to the first partition;

a first compartment separator positioned in the interior space of the first shell, the first compartment separator being positioned perpendicular to and intersecting the first partition and the second partition; and a second compartment separator positioned in the interior space of the first shell parallel to the first compartment separator, the second compartment separator being positioned perpendicular to and intersecting the first partition and the second partition, wherein the first partition, the second partition, the first compartment separator, and the second compartment separator form:

a first compartment within the interior space of the first shell defined by the back panel, a first surface of the first partition, the first compartment separator, the first cover, and the first lid;

a second compartment within the interior space of the first shell defined by the back panel, a second surface of the first partition, the first compartment separator, a first surface of the second partition, the first cover, and the first lid;

a third compartment within the interior space of the first shell defined by the back panel, the first compartment separator, a second surface of the second partition, and the first cover;

a fourth compartment within the interior space of the first shell defined by the back panel, the first compartment separator, the first surface of the first partition, the second compartment separator, and the first cover;

a fifth compartment within the interior space of the first shell defined by the back panel, the first compartment separator, the second surface of the first partition, the second compartment separator, the first surface of the second partition, and the first cover;

a sixth compartment within the interior space of the first shell defined by the back panel, the first compartment separator, the second compartment separator, the second surface of the second partition, and the first cover;

a seventh compartment within the interior space of the first shell defined by the back panel, the second compartment separator, the first surface of the first partition, a compartment floor, and the first cover;

an eighth compartment within the interior space defined by the back panel, the second compartment separator, the second surface of the first partition, the first surface of the second partition, the compartment floor, and the first cover;

a ninth compartment within the interior space defined by the back panel, the second compartment separator, the second surface of the second partition, the compartment floor, and the first cover; and a tenth compartment defined by the interior space of the second shell.

16. The luggage piece of claim 15, wherein the back panel comprises:

a first panel section that corresponds to a first portion of the back panel defining a back surface of the first compartment, the second compartment, the third compartment, the fourth compartment, the fifth compartment, the sixth compartment, the seventh compartment, the eighth compartment, and the ninth compartment; and a second panel section that corresponds to a second portion of the back panel defining a back surface of the tenth compartment, the first panel section having a greater surface area than the second panel section.

17. The luggage piece of claim 15, wherein the back panel further comprises a pocket attached to the interior surface of the back panel, the pocket spanning a length greater than a first length corresponding to the first panel section and a second length corresponding to the second panel section.

18. The luggage piece of claim 17, wherein the length of the pocket is greater than a length of a fencing sword.

* * * * *